US009136590B2

(12) United States Patent
Hotta et al.

(10) Patent No.: US 9,136,590 B2
(45) Date of Patent: Sep. 15, 2015

(54) ELECTRONIC DEVICE PROVIDED WITH ANTENNA DEVICE

(71) Applicant: Kabushiki Kaisha Toshiba, Tokyo (JP)

(72) Inventors: Hiroyuki Hotta, Ome (JP); Koichi Sato, Tachikawa (JP); Ippei Kashiwagi, Fuchu (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 202 days.

(21) Appl. No.: 14/015,682

(22) Filed: Aug. 30, 2013

(65) Prior Publication Data

US 2014/0097993 A1 Apr. 10, 2014

Related U.S. Application Data

(63) Continuation of application No. PCT/JP2013/057306, filed on Mar. 14, 2013.

(30) Foreign Application Priority Data

Oct. 10, 2012 (JP) ..... 2012-224931

(51) Int. Cl.

| | |
|---|---|
| ***H01Q 1/24*** | (2006.01) |
| ***H01Q 1/22*** | (2006.01) |
| ***H01Q 1/48*** | (2006.01) |

(Continued)

(52) U.S. Cl.

CPC ..... *H01Q 1/243* (2013.01); *H01Q 1/2266* (2013.01); *H01Q 1/48* (2013.01); *H01Q 9/42* (2013.01); *H01Q 21/28* (2013.01)

(58) Field of Classification Search

CPC ..... H01Q 1/243; H01Q 1/2266; H01Q 1/48; H01Q 21/28; H01Q 9/42

USPC ..... 343/702; 455/89, 90, 575.7

See application file for complete search history.

(56) References Cited

U.S. PATENT DOCUMENTS

| | | | | |
|---|---|---|---|---|
| 5,943,021 | A * | 8/1999 | Hayes et al. | 343/702 |
| 6,259,897 | B1 * | 7/2001 | Kim | 455/575.7 |

(Continued)

FOREIGN PATENT DOCUMENTS

| | | |
|---|---|---|
| JP | 2006-311449 | 11/2006 |
| JP | 2009-260815 | 11/2009 |

(Continued)

OTHER PUBLICATIONS

International Search Report and Written Opinion from corresponding PCT/JP2013/057306 mailed May 28, 2013.

(Continued)

*Primary Examiner* — Tho G Phan

(74) *Attorney, Agent, or Firm* — William W. Schaal; Rutan & Tucker, LLP

(57) ABSTRACT

In an electronic device, a first housing for receiving a wireless circuit unit and a ground part, a second housing in which a ground part, a hinge mechanism which connects the first and second housings to each other to allow the first and second housings to be rotated, and first and second antennas which resonate for the same frequency band. The first and second antennas are provided in an intermediate portion of the hinge mechanism, and arranged side by side and apart from each other by a predetermined distance in a longitudinal direction of the mechanism. In the mechanism, one of end portions of the mechanism is made electrically conductive, and the other end portion is decreased in electrical conductivity.

4 Claims, 6 Drawing Sheets

(51) Int. Cl.
*H01Q 9/42* (2006.01)
*H01Q 21/28* (2006.01)

(56) References Cited

U.S. PATENT DOCUMENTS

| | | | | |
|---|---|---|---|---|
| 6,272,356 | B1 * | 8/2001 | Dolman et al. | 455/575.3 |
| 6,469,668 | B1 * | 10/2002 | Jones et al. | 343/702 |
| 6,697,022 | B2 * | 2/2004 | Ponce De Leon et al. | 343/702 |
| 6,861,989 | B2 * | 3/2005 | Morningstar et al. | 343/702 |
| 8,368,603 | B2 * | 2/2013 | Huang | 343/702 |
| 2011/0001674 | A1 | 1/2011 | Hikino | |
| 2012/0068893 | A1 | 3/2012 | Guterman et al. | |

FOREIGN PATENT DOCUMENTS

| | | |
|---|---|---|
| JP | 2010-103662 | 5/2010 |
| JP | 2011-029958 | 2/2011 |
| JP | 2012-070386 | 4/2012 |
| WO | 2009/154054 | 12/2009 |

OTHER PUBLICATIONS

English Translation of the International Search Report dated Apr. 17, 2014.

* cited by examiner

<Radiation efficiency of main antenna element>

<Total radiation efficiency of main antenna>

Smith chart (0.6-1.2 GHz)

<Radiation efficiency of main antenna element>

ELECTRONIC DEVICE PROVIDED WITH ANTENNA DEVICE

CROSS REFERENCE TO RELATED APPLICATIONS

This application is a Continuation Application of PCT Application No. PCT/JP2013/057306, filed Mar. 14, 2013 and based upon and claiming the benefit of priority from Japanese Patent Application No. 2012-224931, filed Oct. 10, 2012, the entire contents of all of which are incorporated herein by reference.

FIELD

Embodiments described herein relate generally to an electronic device provided with an antenna device.

BACKGROUND

Various electronic devices have been developed. For example, a notebook personal computer or a cell phone is made to contain a wireless interface for using a wireless network such as a third-generation cellular pone/Long Term Evolution (3G/LTE), a wireless Local Area Network (LAN) or Bluetooth (trademark), and the developed electronic devices can download various data such as content provided from, e.g., a Web site, through the wireless interface.

It should be noted that of antenna devices applied as the above wireless interface, an antenna device is present which achieves spatial diversity or Multiple Input Multiple Output (MIMO). In the antenna device for achieving the spatial diversity or MIMO, a plurality of antennas are arranged apart from each other. Thus, in the case where the antenna device is provided in an electronic device, it is necessary to provide a large space therein, as compared with the case of providing an antenna device comprising a single antenna.

In conventional electronic devices such as notebook personal computers or cell phones, an antenna is provided in an upper portion of an upper housing provided with a display, in order for the housing to be made smaller or designed better. By contrast, electronic devices have been proposed in each of which a number of antennas are arranged in the periphery of a hinge connecting an upper housing and a lower housing including a keyboard, etc (see, e.g., Jpn. Pat. Appln. KOKAI Publication No. 2012-70386).

However, unlike the case where an antenna is provided in an upper portion of a display, in the case where antennas are arranged in the periphery of a hinge, there is a case where the antennas interfere with each other, thus deteriorating their antenna functions such as radiation characteristics. In Jpn. Pat. Appln. KOKAI Publication No. 2012-70386, a passive element is provided between antennas, thus maintaining isolation between the antennas. However, if an electronic device is made smaller or the number of antennas is increased, it is difficult to ensure space for providing a passive element.

An electronic device according to an embodiment comprises: a first housing containing first electronic circuit components including a ground portion and a wireless circuit unit; a second housing containing second electronic circuit components including a ground plate; a hinge mechanism which connects the first housing and the second housing to allow the first and second housings to be rotated; and first and second antennas which resonate for the same frequency band. The first and second antennas are provided in an intermediate portion of the hinge mechanism, and arranged apart from each other by a predetermined distance in a longitudinal direction of the hinge mechanism. One of both end portions of the hinge mechanism is electrically conductive, and the other end portion is restricted in electrical conductivity.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Embodiments will be explained with reference to the drawings.

In general according to one embodiment, an electronic device comprises:

a first housing in which first electronic components including a wireless circuit unit are provided;

a second housing in which second electronic components are provided;

a hinge mechanism which connects the first housing and the second housing to each other to allow the first and second housing to be rotated; and first and second antennas which are provided in an intermediate portion of the hinge mechanism, and arranged side by side and apart from each other by a predetermined distance in a longitudinal direction of the hinge mechanism, the first and second antennas being provided to resonate for the same frequency band, wherein one of end portions of the hinge mechanism is made electrically conductive, and the other end portion is decreased in electrical conductivity.

First Embodiment

Figure 1:
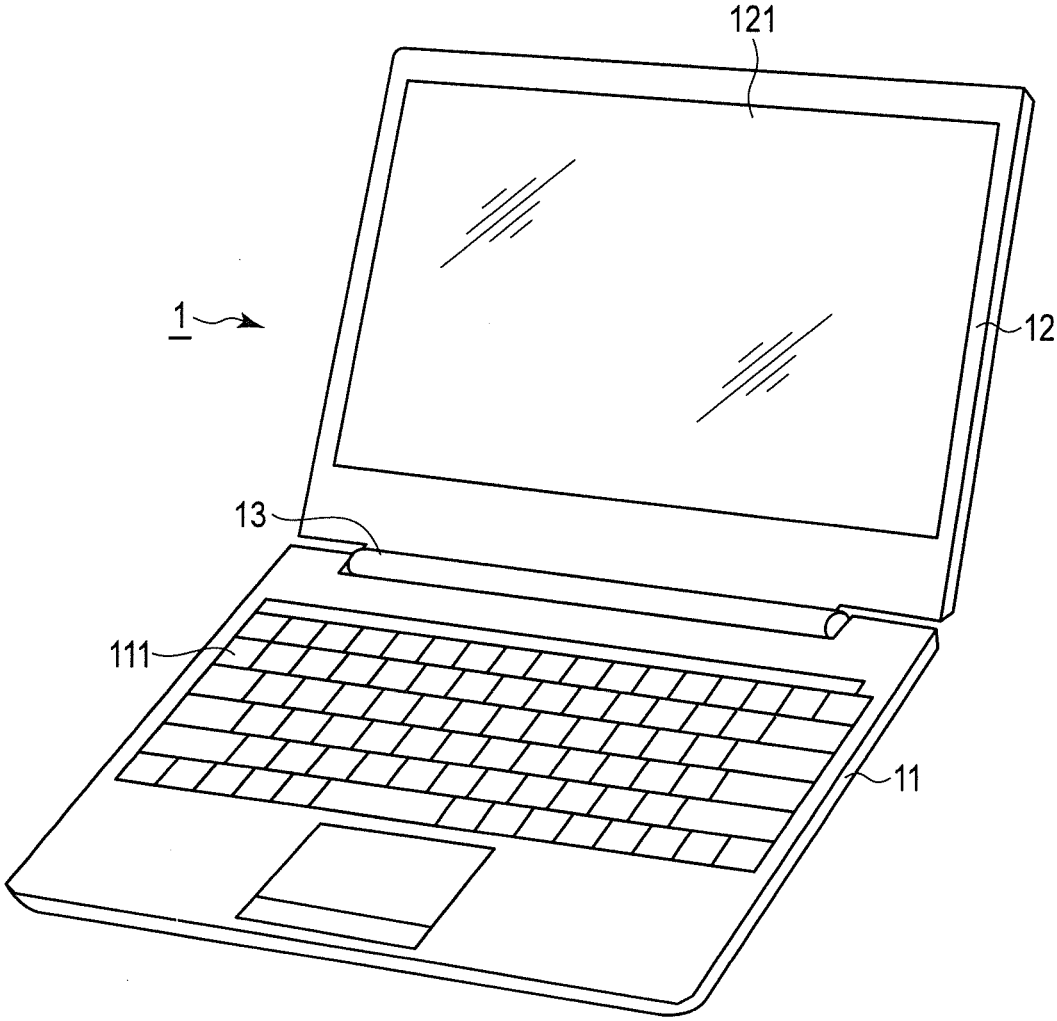
FIG. 1 is a perspective view showing an external appearance of an electronic device according to a first embodiment.

FIG. 1 is a perspective view showing an external appearance of an electronic device according to a first embodiment.

The electronic device comprises a notebook personal computer 1 referred to as, e.g., ULTRABOOK (trademark). In the electronic device, a lower housing 11 and an upper housing 12 are rotatably connected to each other by a hinge mechanism 13; and at the lower housing 11, a keyboard 11 is provided, and at the upper housing 12, a display 121 is provided.

The lower housing 11 contains an electronic circuit unit, a wireless circuit unit and a grounding plate, the electronic circuit unit comprising a CPU, a group of memories and a group of interfaces. As the ground plate, part of a metal housing, a metal member such as a copper foil or a metal ground pattern is applied. The metal ground pattern is formed in a printed wiring board or a board having a limited structure. The upper housing 12 is formed in the shape of a frame to support the display 121.

The hinge mechanism 13 includes a cylindrical engagement portion projectingly provided at the upper housing 12 and cylindrical engagement portions projectingly provided at both edge portions of the lower housing 11. The cylindrical engagement portion of the upper housing 12 is pivoted at the cylindrical engagement portions of the lower housing 11 in such a manner as to enable the cylindrical engagement portions of the upper and lower housing 12 and 11 to be rotated. Those engagement portions include hollow portions through which signal cables are provided to extend and connect electronic components provided in the upper housing 12 and the electronic circuit unit in the lower housing 11 to each other. Furthermore, a high-frequency cable (coaxial cable) is also made to pass through the hollow portions of the engagement portions, connecting the wireless circuit unit and an antenna device which will be described later.

Figure 2:
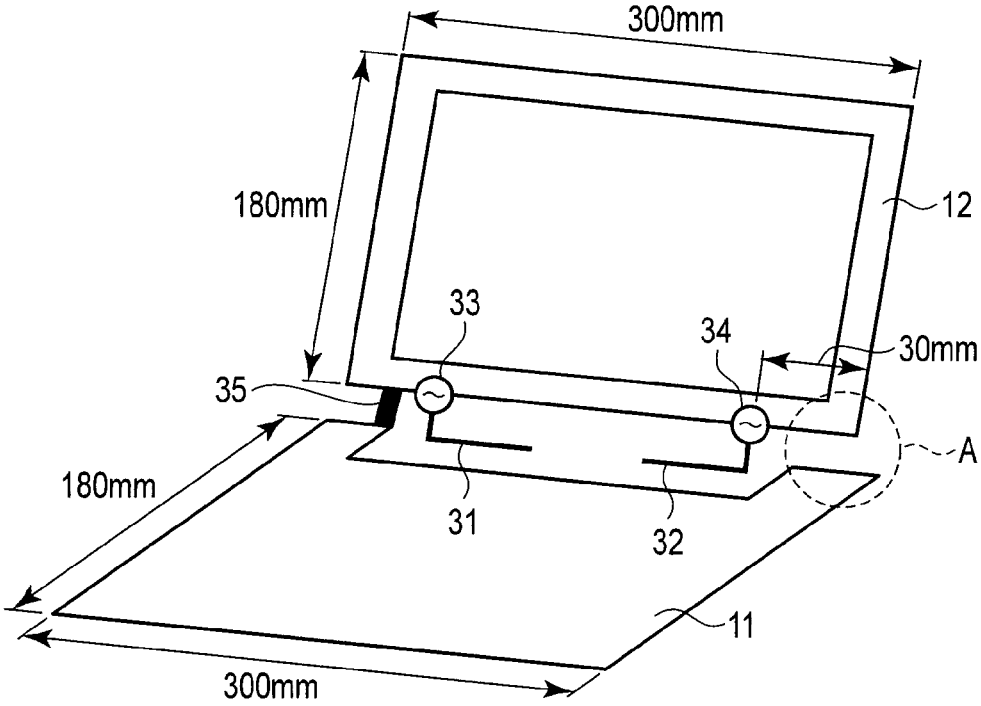
FIG. 2 is a view for diagrammatically showing a structure of the electronic device shown in FIG. 1.

In the hollow portion of the hinge mechanism 13, the antenna device is provided. The antenna apparatus comprises a first antenna 31 and a second antenna 32 which as shown in FIG. 2, are arranged apart from each other by a predetermined distance in a longitudinal direction of the above hollow portion within the hollow portion. The first and second antennas 31 and 32 have element lengths which are set to cause them to resonate for the same first frequency band, and thus operate as MIMO antennas provided for, e.g., a Long Term Evolution (LTE) or a wireless Local Area Network (LAN). It should be noted that although the first and second antennas 31 and 32 are set to resonate for the same frequency band, antennal elements of the first and second antennas 31 and 32 may have different shapes.

Also, the antenna device need not be provided in the hollow portion of the hinge mechanism 13. At least it suffices that the antenna device is provided in parallel with one of four sides (end portions) of the upper housing 12 which is close to a connection side of the lower housing 11 or one of four sides of the lower housing 11 which is close to a connection side of the upper housing 12.

Furthermore, the first and second antennas 31 and 32 are also configured to resonate for a second frequency band, in addition to for the first frequency band. As a result, the antenna provided for, e.g., LTE, operates as a multi-resonant antenna provided for 3G and GPS, and the antenna for wireless LAN operates as a multi-resonant antenna provided for frequencies of 2.5 GHz and 5 GHz. In this embodiment, the first antenna 31 is used as a main antenna (MAIN antenna) provided for 3G and LTE, and the second antenna 32 is used as an auxiliary antenna (AUX antenna) serving only as a receiving antenna for 3G and LTE. It should be noted that the functions of the first antenna 31 and the second antenna 32 are not limited to those of the above example; i.e., they may be set in another manner or other manners.

For example, the first and second antennas 31 and 32 both comprise monopole elements which are L-shaped and laterally L-shaped. The monopole elements have free distal end portions and proximal ends portions connected to feeding terminals 33 and 34, respectively. The feeding terminals 33 and 34 are located close to the engagement portions projectingly provided at the both edge portions of the lower housing 11. Thus, the first and second antennas 31 and 32 are arranged such that their free distal end portions face each other. It should be noted that the free distal end portions of the first and second antenna elements 31 and 32 may be arranged to face in the same direction or opposite directions.

Of engagement portions of both ends of the hinge mechanism 13, as shown in FIG. 2, the engagement portion close to the first antenna 31 comprises a conductive portion 35. Due to provision of the conductive portion 35, the ground plate in the lower housing 11 and the ground plate in the upper housing 12 are electrically connected to each other. On the other hand, of the engagement portions of the both ends of the hinge mechanism 13, at the engagement portion close to the second antenna 32, the ground plate of the lower housing 11 and the ground plate of the upper housing 12 are not electrically connected to each other. To be more specific, in the hinge mechanism 13, for example, a boss for a screwed hole, which is formed of a conductive material, is provided to achieve a conductive state, and an insulating tape is stuck on a connection portion of one of the engagement portions to achieve a nonconductive state.

Figure 3:
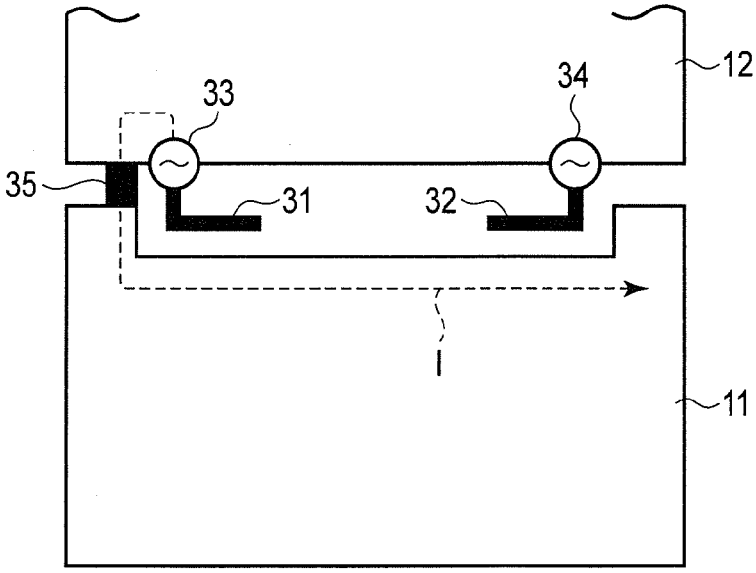
FIG. 3 is a view for showing a flow path of an antenna current in the electronic device shown in FIG. 2.

Due to the above structure, the first and second antennas 31 and 32 are made to operate as MIMO antennas, and at the same time it is ensured that an antenna current I from the feeding terminal 33 of the first antenna 31 to the ground plate of the upper housing 12, as shown in FIG. 3, flows to the ground plate of the lower housing 11 through the conductive portion 35 of the hinge mechanism 13. However, since the engagement portion of the hinge mechanism 13 which is close to the second antenna 32 is not conductive, the antenna current I is not easily received by the feeding terminal 34 of the second antenna 32. Therefore, isolation between the first and second antennas 31 and 32 is improved, also improving the radiation characteristics of the first antenna 31 serving as the main antenna and the second antenna 32 serving as the auxiliary antenna.

Figure 5:
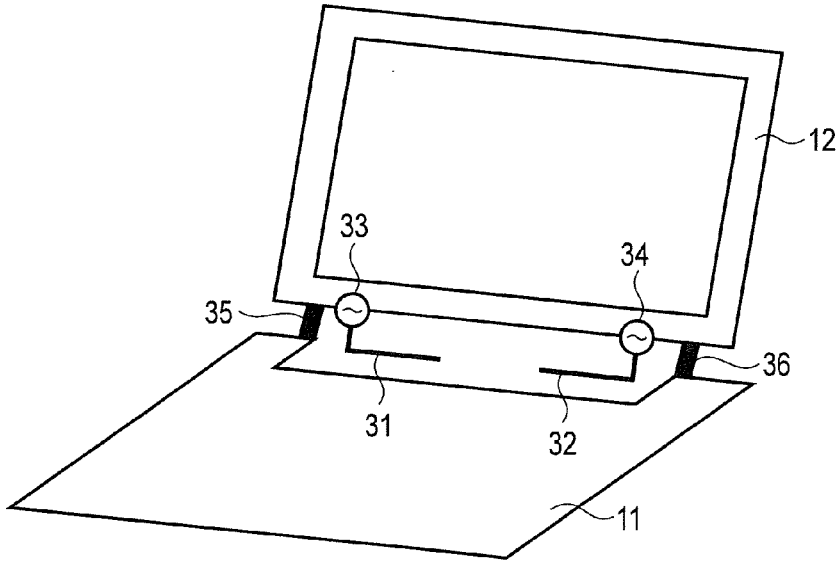
FIG. 5 is a view for diagrammatically showing the structure of the electronic device in the case where the upper housing and the lower housing are electrically connected to each other on both the main antenna side and the auxiliary antenna side.

It should be noted that in the case where as shown in, e.g., FIG. 5, the both ends of the hinge mechanism 13 are rendered conducive due to provision of the conductive portion 35 and a conductive portion 36, the antenna current I from the feeding terminal 33 of the first antenna 31 flows to the ground plate of the lower housing 11 through the conductive portion 35 of the hinge mechanism 13, and then to the feeding terminal 34 of the second antenna 32 through the conductive portion 36 of the hinge mechanism 13. Thus, the radiation efficiency of the first antenna 31 lowers.

Figure 4:
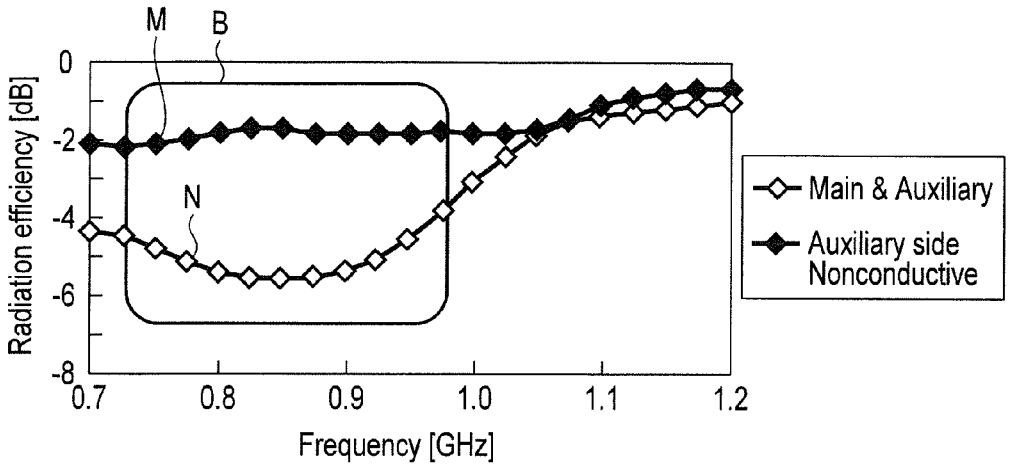
FIG. 4 is a view for showing a comparison between a radiation characteristic of a main antenna shown in FIG. 2 and a characteristic obtained in the case where an upper housing and a lower housing are electrically connected to each other on both a main antenna side and an auxiliary antenna side.

FIG. 4 is a view for showing a comparison between a radiation characteristic M of the first antenna (main antenna) 31 and a radiation characteristic N of the first antenna (main antenna) 31 and second antenna (auxiliary antenna) 32. The radiation characteristic M is obtained in the hinge mechanism 13 according to the first embodiment, wherein the engagement portion of the hinge mechanism 13 which is close to the second antenna 32 is set to be nonconductive as shown in FIG. 5, and the radiation characteristic N is obtained in the hinge mechanism 13 wherein the engagement portions of the both ends of the hinge mechanism 13 are both made conductive by the conductive portions 35 and 36. FIG. 4 shows a result of analysis of the radiation efficiencies which is made without incorporating the mismatch loss. As is clear from FIG. 4, in a target resonant band B (0.7 to 0.96 GHz) to be applied to transmission and reception, the radiation efficiencies of the first antenna 31 serving as the main antenna and the second antenna 32 serving as the auxiliary antenna are greatly improved.

Furthermore, in the first embodiment the antenna current I from the feeding terminal 33 of the first antenna 3, as shown in FIG. 3, flows to the ground plate of the lower housing 11 through the conductive portion 35 of the hinge mechanism 13. Thus, the conductive portion 35 of the hinge mechanism 13 and the ground plate of the lower housing 11 function as great passive elements for the first antenna 31. As a result, another resonance is produced by a housing structure functioning as a passive element, and the first antenna 13 can be made wideband.

Figure 6:
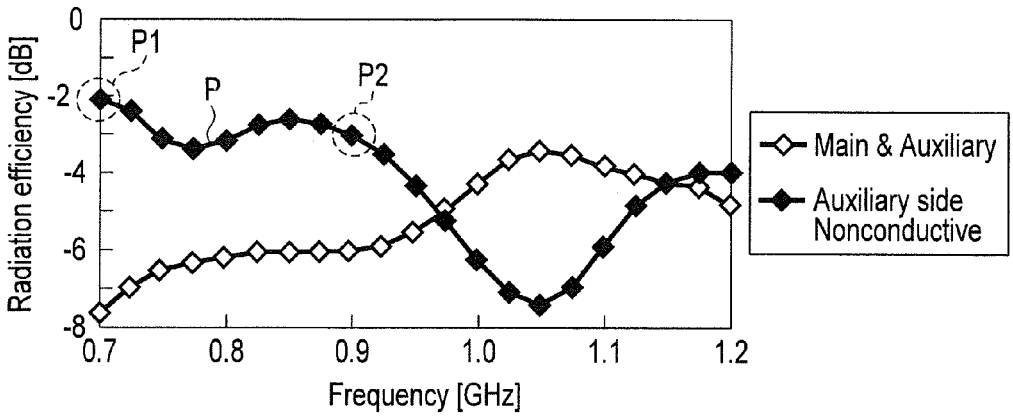
FIG. 6 is a view for showing a comparison between a radiation efficiency (total radiation efficiency) of a main antenna shown in FIG. 2, into which a mismatch loss is incorporated, and the characteristic obtained in the case where the upper housing and the lower housing are electrically connected to each other on both the main antenna side and the auxiliary antenna side.
Figure 7:
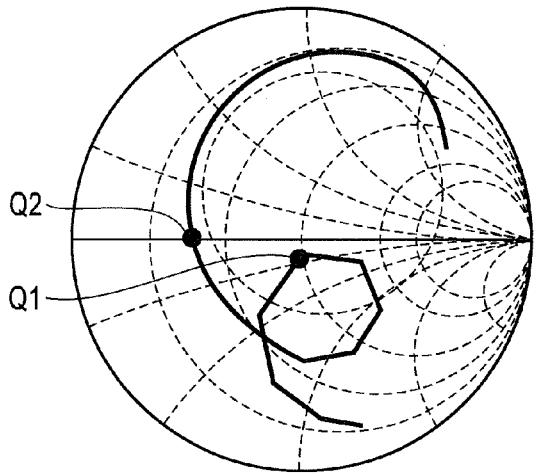
FIG. 7 is a Smith chart for use in explaining an operation of the main antenna shown in FIG. 2.

FIG. 6 shows a total radiation efficiency of the first antenna 31 as a frequency characteristic thereof, and FIG. 7 is a Smith chart of the total radiation efficiency. As shown in FIGS. 6 and 7, in a total radiation characteristic P of the first antenna (main antenna) 31 in the case where the engagement portion of the hinge mechanism 13 which is close to the second antenna 32 is made nonconductive, resonance P1, Q1 is obtained due to the housing structure in addition to the resonance P2, Q2 of the first antenna 31.

It should be noted that if the both ends of the hinge mechanism 13 are made conductive by the conductive portions 35 and 36 as shown in FIG. 5, the antenna current from the feeding terminal of the first antenna 31 flows to the feeding terminal 34 of the antenna element 32 through the conductive portions 35 and 36 and the ground plate of the lower housing 11, and thus the conductive portion 35 and the ground plate of the lower housing 11 do not function as passive elements. Therefore, resonance is not produced by the housing structure, and the first antenna 31 cannot be made wideband.

Second Embodiment

Figure 8:
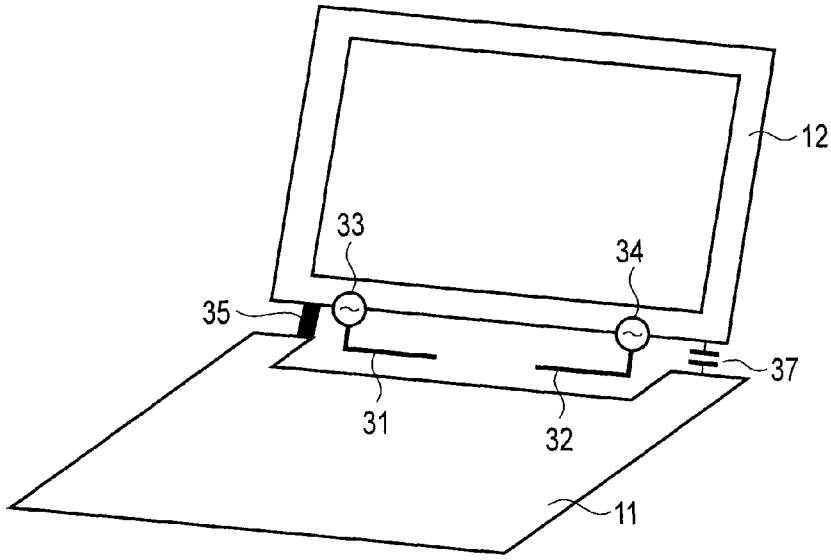
FIG. 8 is a view for diagrammatically showing a structure of an electronic device according to a second embodiment.

FIG. 8 is a view for diagrammatically showing a structure of an electronic device according to a second embodiment.

As shown in FIG. 8, in the electronic device according to the second embodiment, the engagement portion of the hinge mechanism 13 which is close to the second antenna 32 is made nonconductive, and a capacitor 37 is provided at the above engagement portion of the hinge mechanism 13, connecting the ground plate of the lower housing 11 and the ground plate of the upper housing 12. The capacitance of the capacitor 37 is adjusted in accordance with, e.g., a relationship in structure between the engagement portion of the hinge mechanism and the lower housing.

Figure 9:
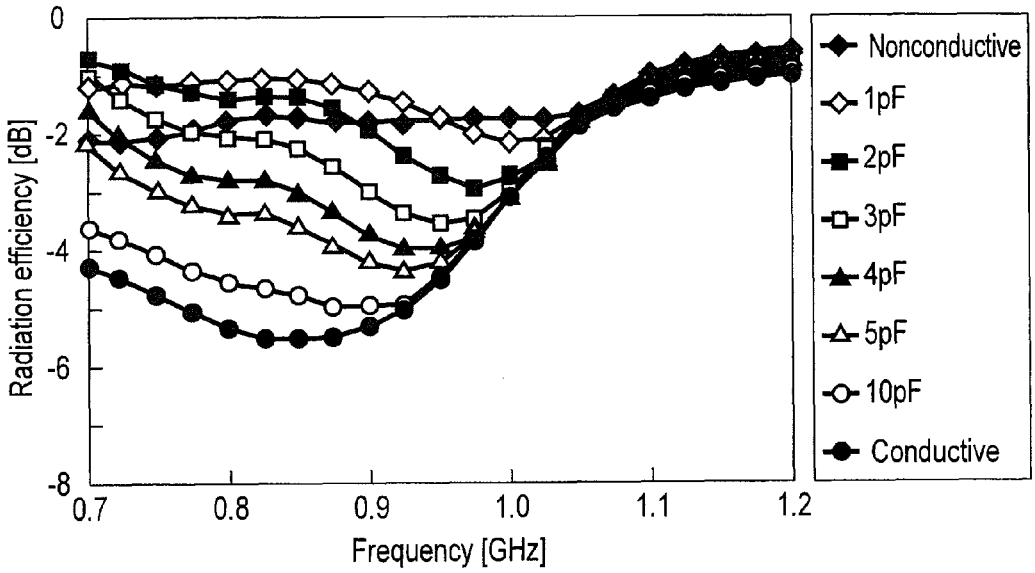
FIG. 9 is a view for showing a radiation efficiency of a main antenna which is obtained when a capacitance of a capacitor in the electronic device shown in FIG. 8 is changed.

FIG. 9 is a view for showing variation of the radiation efficiency of the first antenna 31 with respect to frequency, which depends on the capacitance of the capacitor 37 which is a parameter. As shown in FIG. 9, where a resonant band is 0.7 to 0.96 GHz, if the capacitance of the capacitor 37 is set to 2 pF or less, an obtained radiation efficiency is substantially equivalent to that obtained in the above nonconductive state.

Third Embodiment

Figure 10:
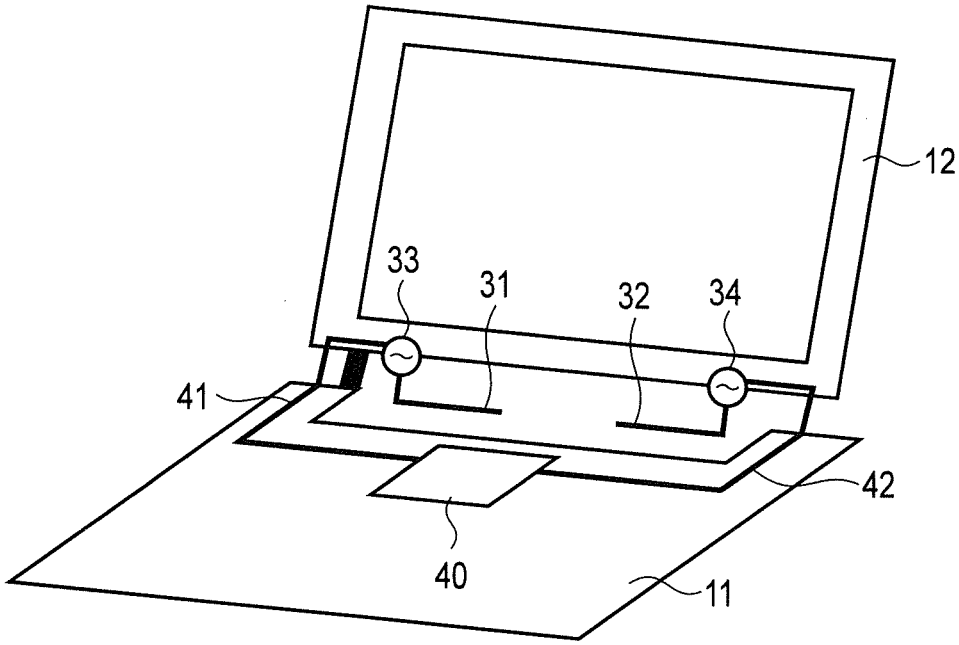
FIG. 10 is a view for diagrammatically showing a wiring structure of high-frequency cables in an electronic device according to a third embodiment.

FIG. 10 is a view for showing a wiring structure of high-frequency cables in an electronic device according to a third embodiment. It should be noted that with respect to FIG. 10, the same elements as in FIG. 2 will be denoted by the same reference numerals as in FIG. 2; and their detailed explanations will be omitted.

The feeding terminals 33 and 34 for the first and second antennas 31 and 32 are arranged close to the engagement portions of the both ends of the hinge mechanism 13. The first and second antennas 31 and 32 comprising L-shaped and laterally L-shaped monopole elements are arranged such that free ends of the first and second antennas 31 and 32 face each other. The feeding terminals 33 and 34 are connected together by high-frequency (RF) coaxial cables 41 and 42. After extending, in the upper housing 12, from the feeding terminals 33 and 34 toward both ends of the upper housing 12, and then extending into the lower housing 11 through the engagement portions of the both end portions of the hinge mechanism 13, high-frequency coaxial cables 41 and 42 are connected to a wireless circuit unit 40 located at an inner portion of the lower housing 11 which is located at a substantially center of the lower housing 11 in a lateral direction thereof.

In such a manner, the high-frequency coaxial cables 41 and 42 are provided without overlapping with the antennas 31 and 32. Thus, the interference of high-frequency coaxial cables 41 and 42 with the first and second antennas 31 and 32 can be restricted, preventing resonant frequencies of the antennas 31 and 32 from becoming different from desired values, and ensuring that desired antenna efficiencies are obtained.

Other Embodiments

The above embodiments are explained by referring, by way of example, to the case where L-shaped and laterally L-shaped monopole elements are applied as the first and second antennas. However, other types of antenna elements such as folded-monopole elements, passive elements or F-shaped and laterally inverted F-shaped elements may be used alone or in combination.

Also, the above embodiments are also explained by referring, by way of example, to the case where a radio signal for 3G or LTE is transmitted and received. They can be applied to the case where a radio signal for use in other wireless systems such as a wireless LAN or Bluetooth is transmitted and received. Furthermore, the electronic device is not limited to the notebook personal computer; i.e., a cell phone, a game machine, an electronic dictionary, etc., may be applied as the electronic device, as long as they have a hinge mechanism. The kind or structure of the electronic device, the structure of the hinge mechanism and means for rendering one of the engagement portions of the hinge mechanism conductive may be variously modified.

In addition, according to the above explanations of the above embodiments, one of the engagement portions of the hinge mechanism is made nonconductive. However, said one of the engagement portions of the hinge mechanism need not be made nonconductive. For example, if a conductivity restriction member is provided which decreases or restricts the conductivity of the engagement portion close to the second antenna 32 such that the conductivity is lower than the conductivity of the engagement portion close to the first antenna 31, an antenna efficiency close to the desired antenna efficiency to some extent can be expected.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An electronic device comprising:

a first housing in which first electronic components including a wireless circuit unit are provided;

a second housing in which second electronic components are provided;

a hinge mechanism which connects the first housing and the second housing to each other to allow the first and second housing to be rotated; and first and second antennas which are provided in an intermediate portion of the hinge mechanism, and arranged side by side and apart from each other by a predetermined distance in a longitudinal direction of the hinge mechanism, the first and second antennas being provided to resonate for the same frequency band, wherein one of end portions of the hinge mechanism is made electrically conductive, and the other end portion is decreased in electrical conductivity.

2. The electronic device according to claim 1, wherein in a case where the first antenna and the second antenna are used as a main antenna and an auxiliary antenna, respectively, one of the end portions of the hinge mechanism which is close to the first antenna is made electrically conductive, and the other of the end portions of the hinge mechanism which is close to the second antenna is restricted decreased in electrical conductivity.

3. The electronic device according to claim 1, further comprising a mechanism configured to electrically connect a ground portion provided in the first housing and a ground portion in the second housing to each other with a predetermined capacitance, the mechanism being provided at the other of the end portions of the hinge mechanism which is decreased in electrical conductivity.

4. The electronic device according to claim 1, wherein the first and second antennas comprise respective feeding points located close to the end portions of the hinge mechanism.

* * * * *